US010518317B2

(12) United States Patent
McFarlane

(10) Patent No.: US 10,518,317 B2
(45) Date of Patent: Dec. 31, 2019

(54) METHOD OF MOULDING A SETTABLE MATERIAL

(71) Applicant: James Andrew McFarlane, Benoni (ZA)

(72) Inventor: James Andrew McFarlane, Benoni (ZA)

( * ) Notice: Subject to any disclaimer, the term of this patent is extended or adjusted under 35 U.S.C. 154(b) by 0 days.

(21) Appl. No.: 16/073,535

(22) PCT Filed: Jan. 16, 2017

(86) PCT No.: PCT/ZA2017/050004
§ 371 (c)(1),
(2) Date: Jul. 27, 2018

(87) PCT Pub. No.: WO2017/139814
PCT Pub. Date: Aug. 17, 2017

(65) Prior Publication Data

US 2019/0030594 A1 Jan. 31, 2019

(30) Foreign Application Priority Data

Feb. 10, 2016 (ZA) ..... 2016/00938

(51) Int. Cl.
*B22C 9/20* (2006.01)
*B22D 5/04* (2006.01)
(Continued)

(52) U.S. Cl.
CPC ..... *B22C 9/20* (2013.01); *B22D 5/04* (2013.01); *B22D 47/02* (2013.01); *B22C 9/12* (2013.01); *B22D 27/04* (2013.01)

(58) Field of Classification Search
CPC .... B22C 9/20; B22C 9/12; B22C 9/08; B22C 9/082; B22C 11/00; B22C 11/02;
(Continued)

(56) References Cited

U.S. PATENT DOCUMENTS 1,049,644 A 1/1913 Baker
1,359,196 A 11/1920 Rau
(Continued)

FOREIGN PATENT DOCUMENTS

CN 100450671 C 1/2009
EP 0174855 A2 3/1986
GB 895426 5/1962

OTHER PUBLICATIONS

Search Report and Written Opinion dated May 24, 2017 in international patent application serial No. PCT/ZA2017/050004.

*Primary Examiner* — Kevin P Kerns
*Assistant Examiner* — Steven S Ha
(74) *Attorney, Agent, or Firm* — Haugen Law Firm PLLP

(57) ABSTRACT

A method of moulding a settable material includes the steps of: (i) providing a first mould or mould cavity; (ii) providing an outlet from which a settable material is discharged; (iii) aligning the first mould or mould cavity with the outlet; (iv) discharging settable material from the outlet into the first mould or mould cavity; (v) providing a second mould or mould cavity; (vi) displacing the first mould or mould cavity away from the outlet; (vii) aligning the second mould or mould cavity with: (a) the outlet; and (b) the first mould or mould cavity such that the second mould or mould cavity is in fluid communication with the first mould or mould cavity; (viii) discharging settable material from the outlet into the second mould or mould cavity; (ix) permitting a portion of the settable material discharged into the second mould or mould cavity to flow from within the second mould or mould cavity to within the first mould or mould cavity; (x) further displacing the first mould or mould cavity and the second mould or mould cavity away from the outlet; (xii) permitting: (a) the settable material in the first mould or mould cavity to set into a first moulded article; and (b) the settable material in the second mould or mould cavity to set into a
(Continued)

second moulded article; and (xiii) severing the first moulded article from the second moulded article.

19 Claims, 8 Drawing Sheets

(51) Int. Cl.
*B22D 47/02* (2006.01)
*B22C 9/12* (2006.01)
*B22D 27/04* (2006.01)

(58) Field of Classification Search
CPC ..... B22C 11/12; B22D 5/04; B22D 47/02; B22D 27/04
See application file for complete search history.

(56) References Cited

U.S. PATENT DOCUMENTS

| | | | |
|---|---|---|---|
| 1,615,696 | A | 1/1927 | Gutierrez |
| 2,742,682 | A | 4/1956 | Pearson |
| 2,799,906 | A | 7/1957 | Duncan |
| 2,910,745 | A | 11/1959 | Norton |
| 3,099,867 | A | 8/1963 | Ponting |
| 3,905,735 | A | 9/1975 | Thomas et al. |
| 4,159,732 | A | 7/1979 | Handkammer |

METHOD OF MOULDING A SETTABLE MATERIAL

BACKGROUND

The present invention relates to a method of moulding a settable material. More particularly, the present invention relates to a continuous process for moulding a settable material wherein interlinked moulds are displaced from a material feed and shrinkage in downstream moulds is compensated for by material flow from upstream moulds.

Various methods of moulding a settable material exist. For instance:

U.S. Pat. No. 1,049,644 "Mold forming and casting apparatus" describes a movable track that supports a continuous sand mould that defines a series of spaced mould cavities. The track conveys the sand mould along a decline past a ladle for filling the mould cavities with molten metal. A drawback of this system is that, adjacent mould cavities are not in fluid communication with each other. As such, metal shrinkage in a mould cavity cannot be compensated for by the flow of molten metal from an adjacent mould cavity.

U.S. Pat. No. 1,615,696 "Casting machine" describes a casting process wherein moulds connected to a continuous belt are passed by a cope for introducing molten metal into the moulds. A similar system is described in U.S. Pat. No. 3,099,867 "Casting machines". A drawback of these systems is that, adjacent moulds are not in fluid communication with each other. As such, metal shrinkage in a mould cannot be compensated for by the flow of molten metal from an adjacent mould.

U.S. Pat. No. 3,905,735 "Stack moulding apparatus" describes a process for stack moulding pressed articles. As with the patents referred to above, each moulded article in the stack is not in fluid communication with adjacent articles.

U.S. Pat. No. 2,742,682 "Continuous moulding apparatus" describes a movable track that supports a series of abutting sand moulds thereon. The track is inclined in the direction of mould travel. Each mould is in fluid communication with adjacent moulds via a channel. As the moulds are conveyed upwards, along the inclined track, a pouring basin/launder system pours molten metal into the channel, which molten metal travels along the channel to fill the mould located beneath the launder and lower moulds that have yet to reach the launder system. A similar system is described in U.S. Pat. No. 2,799,906 "Apparatus and method of filling ingot molds" and U.S. Pat. No. 2,910,745 "Moving mold casting apparatus". A drawback of this system is that, after a mould has passed the launder system, shrinkage in a mould cannot be compensated for by the flow of molten metal from an adjacent mould.

Various other patents (for example GB895,426 "Improvements in and relating to shell moulds and cores" and U.S. Pat. No. 1,359,196 "Multiple mold casting apparatus") describe vertical mould stacks, wherein each mould in the stack is in fluid communication with adjacent moulds, and wherein the mould stack is filled with molten metal from the top. A drawback of this casting method is that it is not continuous.

It is an object of the present invention to provide a method of moulding that addresses these drawbacks.

SUMMARY OF THE INVENTION

According to a preferred embodiment of the invention, there is provided a method of moulding a settable material, which method includes the steps of:

providing a first mould or mould cavity;

providing an outlet from which a settable material is discharged;

aligning the first mould or mould cavity with the outlet;

discharging settable material from the outlet into the first mould or mould cavity;

providing a second mould or mould cavity;

displacing the first mould or mould cavity away from the outlet;

aligning the second mould or mould cavity with: (i) the outlet; and (ii) the first mould or mould cavity such that the second mould or mould cavity is in fluid communication with the first mould or mould cavity;

discharging settable material from the outlet into the second mould or mould cavity;

permitting a portion of the settable material discharged into the second mould or mould cavity to flow from within the second mould or mould cavity to within the first mould or mould cavity;

further displacing the first mould or mould cavity and the second mould or mould cavity away from the outlet;

permitting: (i) the settable material in the first mould or mould cavity to set into a first moulded article; and (ii) the settable material in the second mould or mould cavity to set into a second moulded article; and severing the first moulded article from the second moulded article.

Typically, the method further includes the step of clamping: (i) the first moulded article or the first mould or mould cavity; and (ii) the second moulded article or the second mould or mould cavity prior to severing the first moulded article from the second moulded article.

Generally, the method further includes the step of: (i) ejecting the first moulded article from the first mould or mould cavity and ejecting the second moulded article from the second mould or mould cavity; or (ii) removing the first mould or mould cavity from around the first moulded article and removing the second mould or mould cavity from around the second moulded article, which step may occur either before or after the first moulded article is severed from the second moulded article.

Preferably, the step of severing the first moulded article from the second moulded article is performed by plasma arc cutting, flame cutting or melting using electricity.

Optionally, the second mould or mould cavity is in fluid communication with the first mould or mould cavity via a conduit. In such embodiment: the settable material discharged into the second mould or mould cavity may flow from within the second mould or mould cavity to within the first mould or mould cavity via the conduit; and the first moulded article may be severed from the second moulded article in the region of the conduit. Preferably, the conduit extends from near the operative bottom of the second mould or mould cavity to near the operative top of the first mould or mould cavity.

Typically, both the first mould or mould cavity and the second mould or mould cavity are sand moulds.

Generally, the first mould or mould cavity and the second mould or mould cavity are connected to a belt or chain loop.

Preferably, the belt or chain loop causes and controls movement of the first mould or mould cavity and the second mould or mould cavity.

Typically, the belt or chain loop comprises a chain and sprocket tower.

Generally, bars extending from the first mould or mould cavity and bars extending from the second mould or mould cavity extend to and are connected to the belt chain or loop.

Preferably, the method further includes the step of conveying the first moulded article along a conveyor belt after the first moulded article has been severed from the second moulded article.

Typically, the method further includes the step of securing the first mould or mould cavity to the second mould or mould cavity via a clipping arrangement before discharging settable material from the outlet into the second mould or mould cavity.

Generally: displacement of the first mould or mould cavity; further displacement of the first mould or mould cavity; and further displacement of the second mould or mould cavity, is in an operatively downwards direction.

Preferably, the steps of:

displacing the first mould or mould cavity away from the outlet; and aligning the second mould or mould cavity with: (i) the outlet; and (ii) the first mould or mould cavity such that the second mould or mould cavity is in fluid communication with the first mould or mould cavity, are performed simultaneously.

Optionally, the outlet extends through the mould cavity defined by the second mould, via the conduit and into the mould cavity defined by the second mould prior to discharging settable material via the second mould and via the conduit into the mould cavity defined by the second mould.

The first and second moulds may be wedge-shaped to form an arc when stacked.

BRIEF DESCRIPTION OF THE DRAWINGS

The invention will now be described in more detail, by way of examples only, with reference to the accompanying drawings in which.

DESCRIPTION OF THE INVENTION

Figure 1:
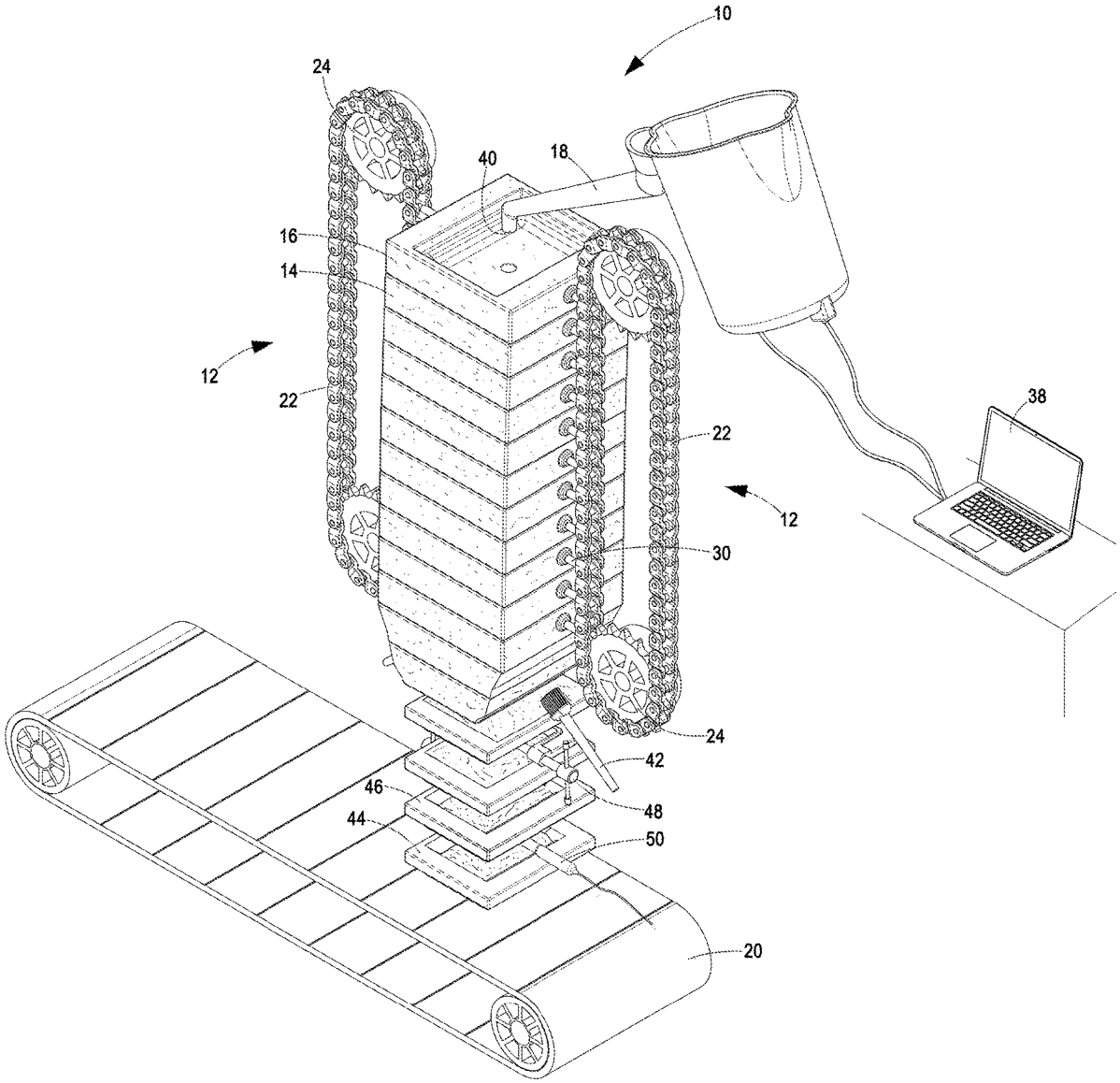
FIG. 1 is a perspective view of casting system that exercises the method according to the invention.

With reference to FIGS. 1 to 6 of the drawings, a casting system 10 includes a chain and sprocket tower 12, a first mould 14, a second mould 16, a launder system 18 and a conveyor 20.

The chain and sprocket tower 12 comprises a chain loop 22 driven by a sprocket 24. It will be appreciated that the chain loop 22 could be substituted with a belt loop.

The first and second moulds 14 and 16 are sand moulds. Each mould 14 and 16 defines a mould cavity 26 for moulding settable material 36 poured therein. The base of each mould 14 and 16 defines a conduit 28 that permits fluid communication between the mould cavity 26 defined by a superjacent mould 16 and the mould cavity 26 defined by a subjacent mould 14. Preferably, the conduit 28 inlet is spaced from the operative bottom of the mould cavity 26 a distance less than a third of the depth of the mould cavity 26. Most preferably, the conduit 28 inlet is located at the operatively lowest part of the mould cavity 26.

Bars 30, which are partly embedded at one end within the moulds 14 and 16, extend from the moulds 14 and 16. The bars 30 extend towards and are connected to the chain loop 22 such that revolving the chain loop 22 causes movement of the moulds 14 and 16 secured thereto. Preferably, resilient elastomeric seats (not shown) are disposed between: (i) the bars 30 and the chain loop 22; and (ii) the bars 30 and the first and second moulds 14 and 16, which seats are intended to absorb impact loads transmitted between the moulds 14 and 16 on the one hand and the chain loop 22 on the other hand.

Each mould 14 and 16 includes a first clipping formation (not shown) near the operative top of the mould 14 and 16, and a corresponding second clipping formation (not shown) near the operative bottom of the mould 14 and 16. These first and second clipping formations are arranged such that, when the second mould 16 is placed on top of the first mould 14, the first clipping formation on the first mould 14 engages the second clipping formation on the second mould 16 to secure the first and second moulds 14 and 16 to each other.

When the second mould 16 is stacked above the first mould 14, the mould cavity 26 defined by the second mould 16 is in fluid communication with the mould cavity 26 defined by the first mould 14 via the conduit 28.

The launder system 18 is associated with a heating element (not shown) for pre-heating the launder system 18. During operation, the launder system 18 is charged with a settable material 36 discharged from a pouring ladle (not shown) The term "settable material" 36 is intended to include any material that hardens during the moulding process, whether from a change in temperature or by a chemical reaction. Typically the settable material 36 is a molten metal.

A computer 38 controls discharge of settable material 36 from the launder system 18 outlet 40 by regulating an outlet valve (not shown) and/or tilt of the launder system 18. Settable material 36 discharged from the launder system 18 via the outlet 40 is intended to enter a mould 14 or 16 that is aligned with the outlet 40. The computer 38 could also control operation of the chain and sprocket tower 12, and thereby movement of the first and second moulds 14 and 16.

It will be appreciated that equivalents to a launder system 18 may be used, e.g. a ladle/press pour system or a bottom pour system.

A weighing means (not shown) (e.g. load cells) could be associated with the moulds 14 and 16 and/or the launder system 18, and integrated with the computer 38. By monitoring mould 14 and 16 and/or launder system 18 weight, the discharge of settable material 36 from the launder system 18 outlet 40 can be regulated to a high degree of precision to ensure optimal filling of the moulds 14 and 16.

A mould removal means 42 in the form of rotating metal brushes associated with a pneumatic air gun acts to disintegrate the moulds 14 and 16, revealing the first moulded article 44 cast within the first mould 14 and the second moulded article 46 cast within the second mould 16.

Clamps 48, located operatively below the mould removal means 42 clamp the first and second moulds 14 and 16 to secure them in place relative to each other.

Disposed operatively beneath the clamps 48 is a means 50 for severing set material 36 from the first and second moulded articles 44 and 46 (or from therebetween). The severing means 50 is shown in the form of a plasma arc cutter that can revolve around the moulded articles 44 and 46 to sever the first moulded article 44 from the second moulded article 46. Alternatively, the means 50 could sever the set material 36 by flame cutting or melting using electricity. Importantly, the severing means 50 should not use a cutting method that requires physical, abrasive contact between the severing means 50 and the set material 36, as such contact may induce vibrations in the casting system 10 that negatively impacting casting quality.

The conveyor 20 has a mesh belt that permits sand to pass therethrough, while supporting moulded articles 44 and 46 that have been separated by the severing means 50 thereon.

During operation of the casting system 10:

The first mould 14 is aligned with the launder system 18 outlet 40.

Figure 2:
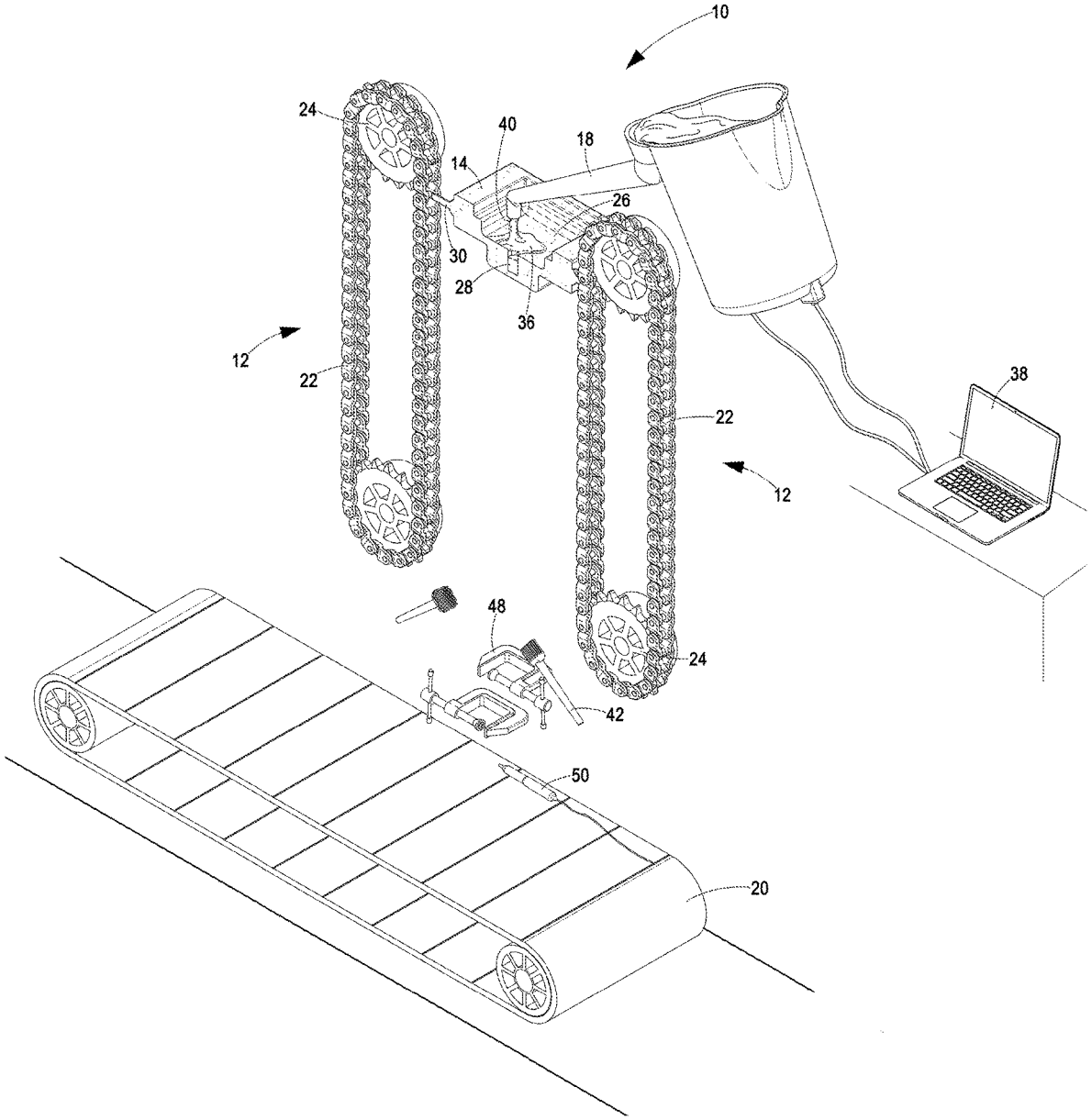
FIG. 2 is a partially cut-away side view of the casting system in FIG. 1 showing the first mould being charged with settable material.

Referring to FIG. 2, the launder system 18 discharges settable material 36 via the outlet 40 into the first mould 14, which discharge is controlled by the computer 38 (using feedback from the weighing means). It will be appreciated that the conduit 28 defined by the first mould 14 may need to be blocked by a stopper to prevent the settable material from escaping the mould cavity 26 defined by the first mould 14 when no subjacent mould is present.

The first mould 14 is then displaced downwards, away from the launder system 18 outlet 40.

(Either after or while displacing the first mould 14 from the outlet 40) the second mould 16 is moved into alignment with the launder system 18 outlet 40, and placed over the first mould 14 such that the mould cavity 26 defined by the second mould 16 is in fluid communication with the mould cavity 26 defined by the first mould 14.

The clipping formations secure the second mould 16 to the first mould 14. During this step, a glue disposed between the first and second moulds 14 and 16 may assist in sealably binding the first and second moulds 14 and 16 to each other.

Figure 3:
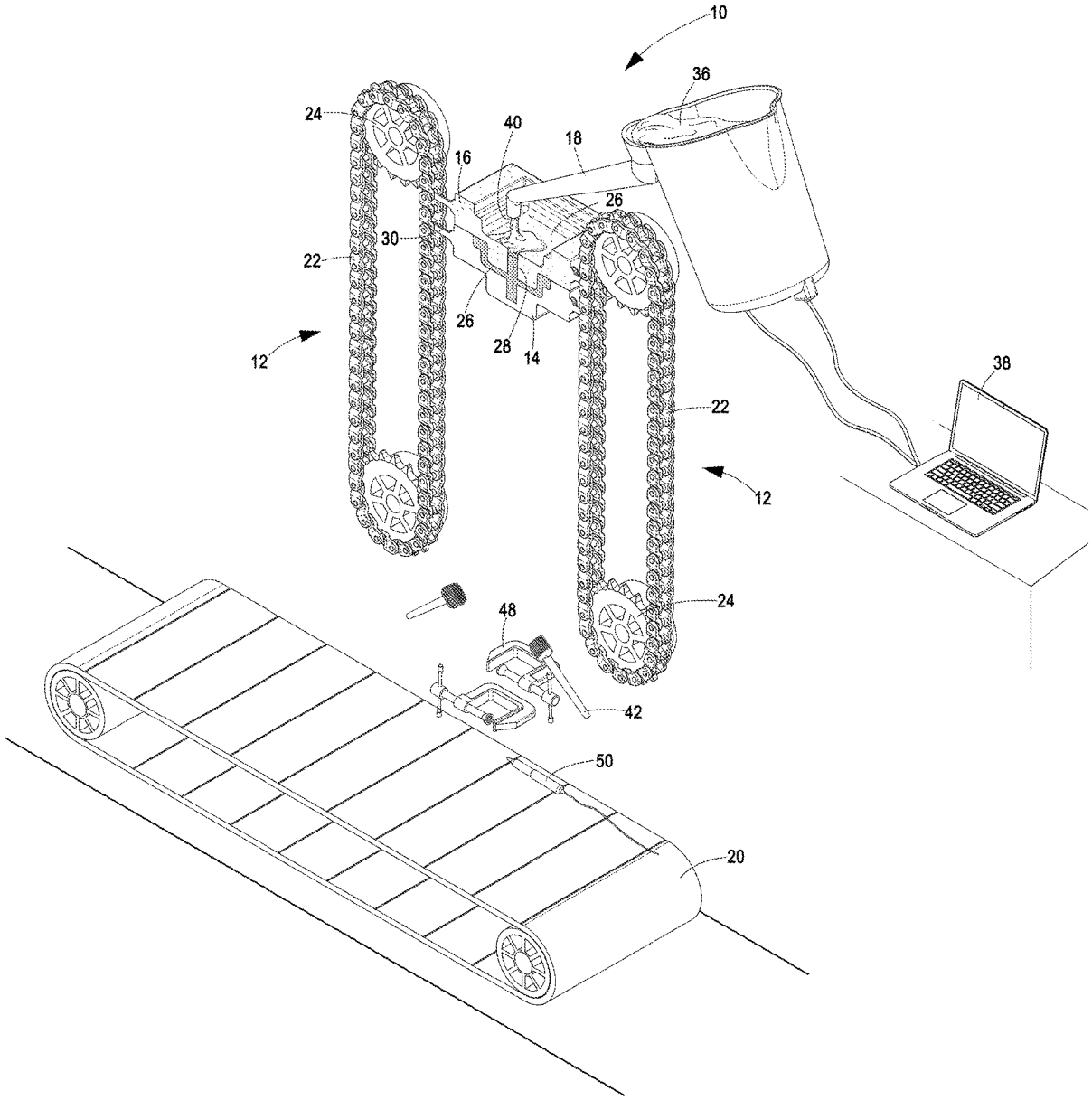
FIG. 3 is a partially cut-away side view of the casting system in FIG. 1 showing the second mould being charged with settable material.

Referring to FIG. 3, the launder system 18 then discharges settable material 36 via the outlet 40 into the second mould 16, which discharge is controlled by the computer 38 (using feedback from the weighing means).

Optionally, but not shown, the outlet 40 could protrude via the second mould 16 and the conduit 28 into the settable material 36 in the mould cavity 26 defined by the first mould 14 prior to discharging further settable material 36 within the body of settable material 36 in the mould cavity 26 defined by the first mould 14. As further settable material 36 is discharged from the outlet 40, the further settable material causes the body of settable material in the mould cavity 26 defined by the first mould 14 to flow into the mould cavity 26 defined by the superjacent second mould 16. During this process, the outlet 40 is continually raised via the conduit 28 and into the mould cavity 26 defined by the second mould 16, while remaining below the surface of the settable material in the mould cavities 26 defined by the first and second moulds 14 and 16. When the mould cavity 26 defined by the second mould 16 has been filled with settable material 36, flow of settable material 36 is stopped and the outlet 40 is extracted from the mould cavity 26 defined by the second mould 16. By maintaining the outlet 40 submerged in settable material 36 during filling of the second mould 16 with settable material 36, the exposure of settable material 36 to air during pouring is minimised.

The conduit 28 defined by the second mould 16 permits settable material 36 contained within the mould cavity 26 defined by the second mould 16 to flow via the conduit 28 from the bottom of the mould cavity 26 defined by the second mould 16 into the top of the mould cavity 26 defined by the first mould 14. This ensures (to a degree) that the mould cavity 26 defined by the first mould 14 remains full of settable material 36 despite shrinkage of settable material 36 contained within the first mould 14 during casting/setting/cooling.

Both the first mould 14 and second mould 16 are then further displaced downwards, away from the launder system 18 outlet 40. It will be appreciated that following such further displacement, a further mould may be placed above the second mould and charged with settable material 36 via the launder system 18 outlet 40. The intention is for these steps to be repeated in order to provide a continuous moulding process.

The settable material 36 in the first and second moulds 14 and 16 is then permitted to set (e.g. through cooling or by a chemical reaction) to form first and second moulded articles 44 and 46, respectively.

The rotating metal brushes and pneumatic air gun 42 then act upon the first and second moulds 14 and 16 to disintegrate the moulds 14 and 16, exposing the first and second moulded articles 44 and 46.

Figure 4:
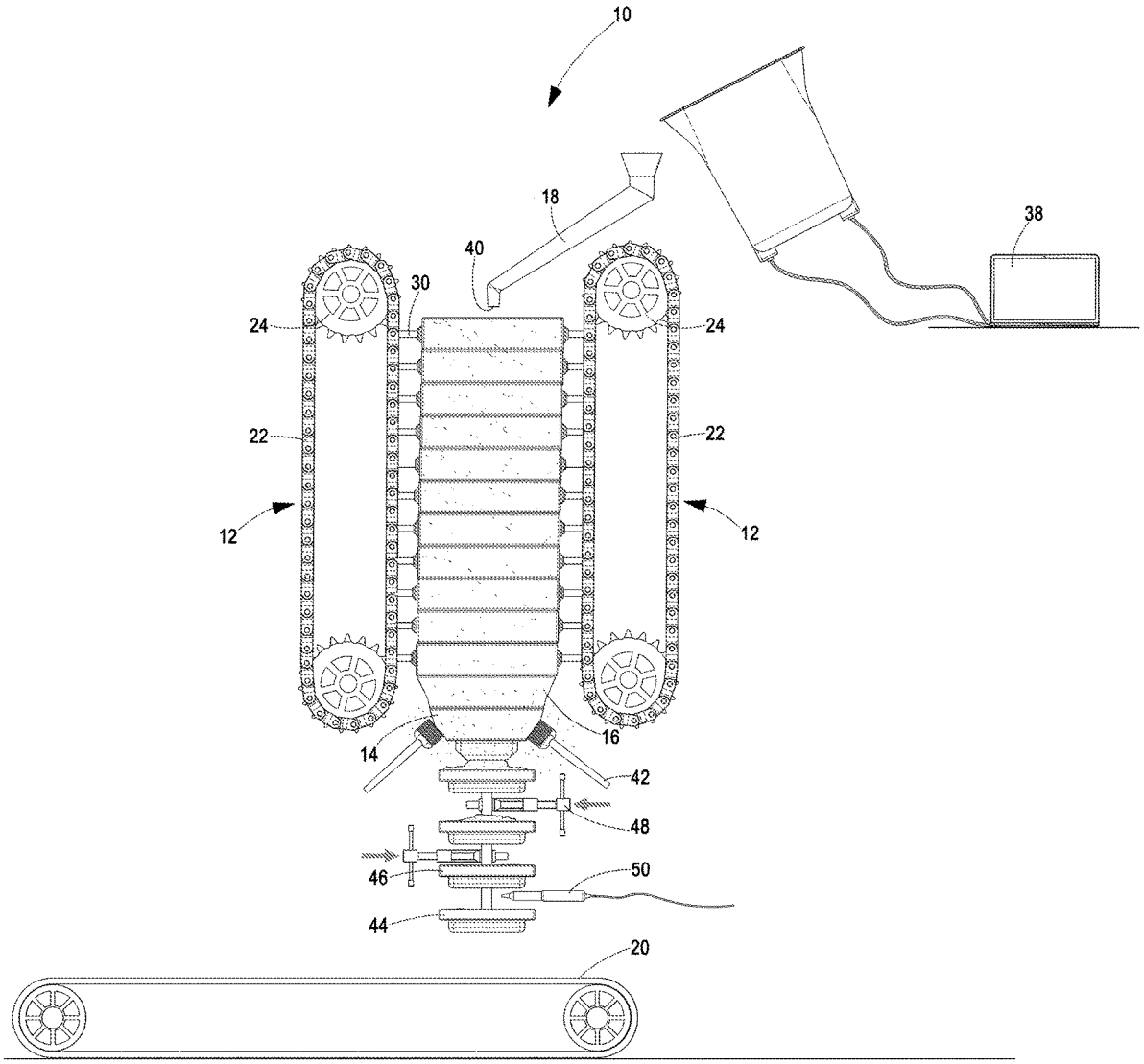
FIG. 4 is a side view of the casting system in FIG. 1 showing the first moulded article and the second moulded article clamped by clamps.
Figure 5:
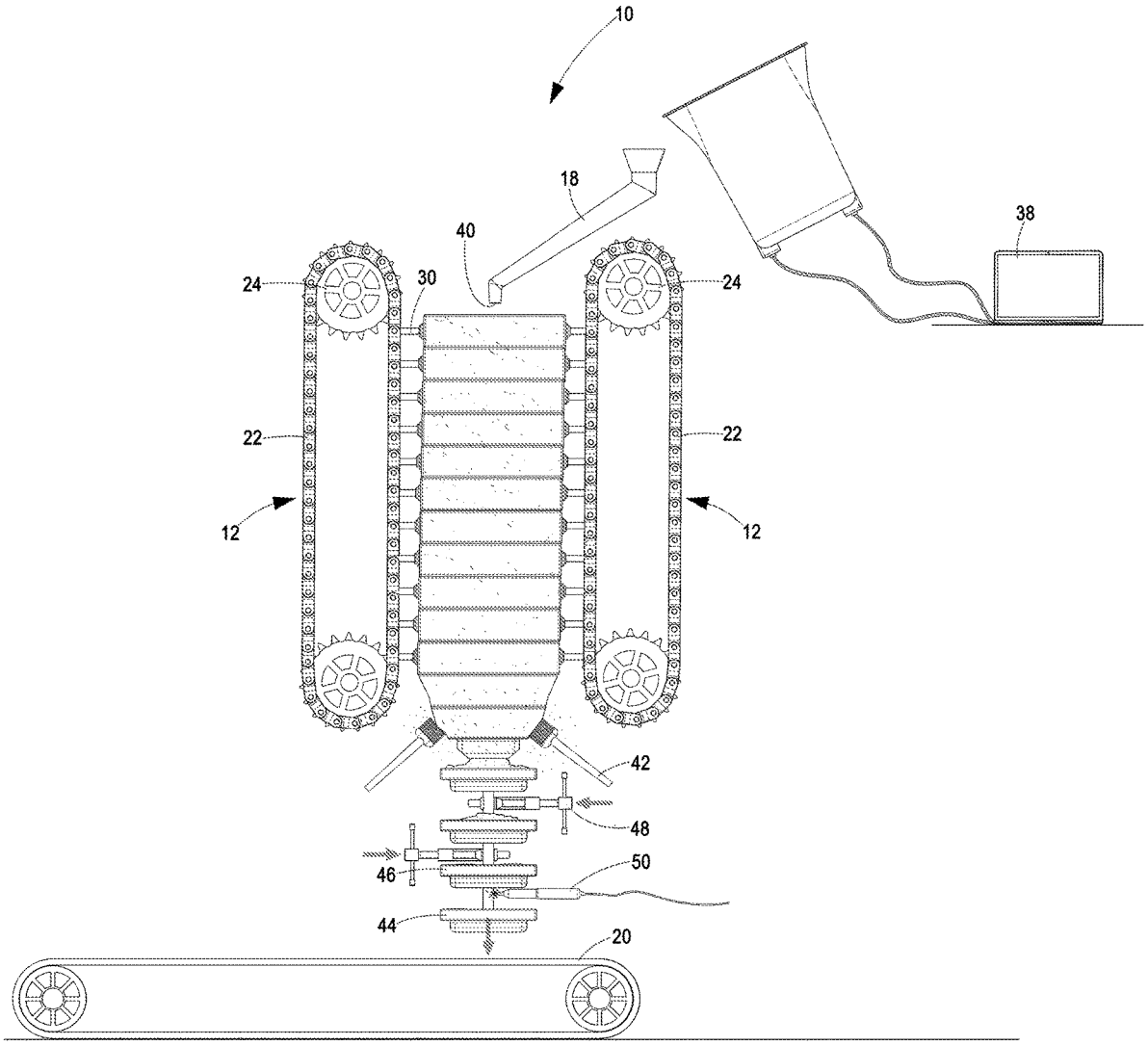
FIG. 5 is a side view of the casting system in FIG. 1 showing the first moulded article being severed from the second moulded article.

Referring to FIG. 4, the clamps 48 then clamp the first and second moulds 44 and 46 while the plasma arc cutter 50 revolves about the first and second moulded articles 44 and 46, severing the first moulded article 44 from the second moulded article 46, as shown in FIG. 5. Typically the settable material 36 that set within the conduit 28 is removed by the plasma arc gun 50 to separate the first moulded article 44 from the second moulded article 46.

Figure 6:
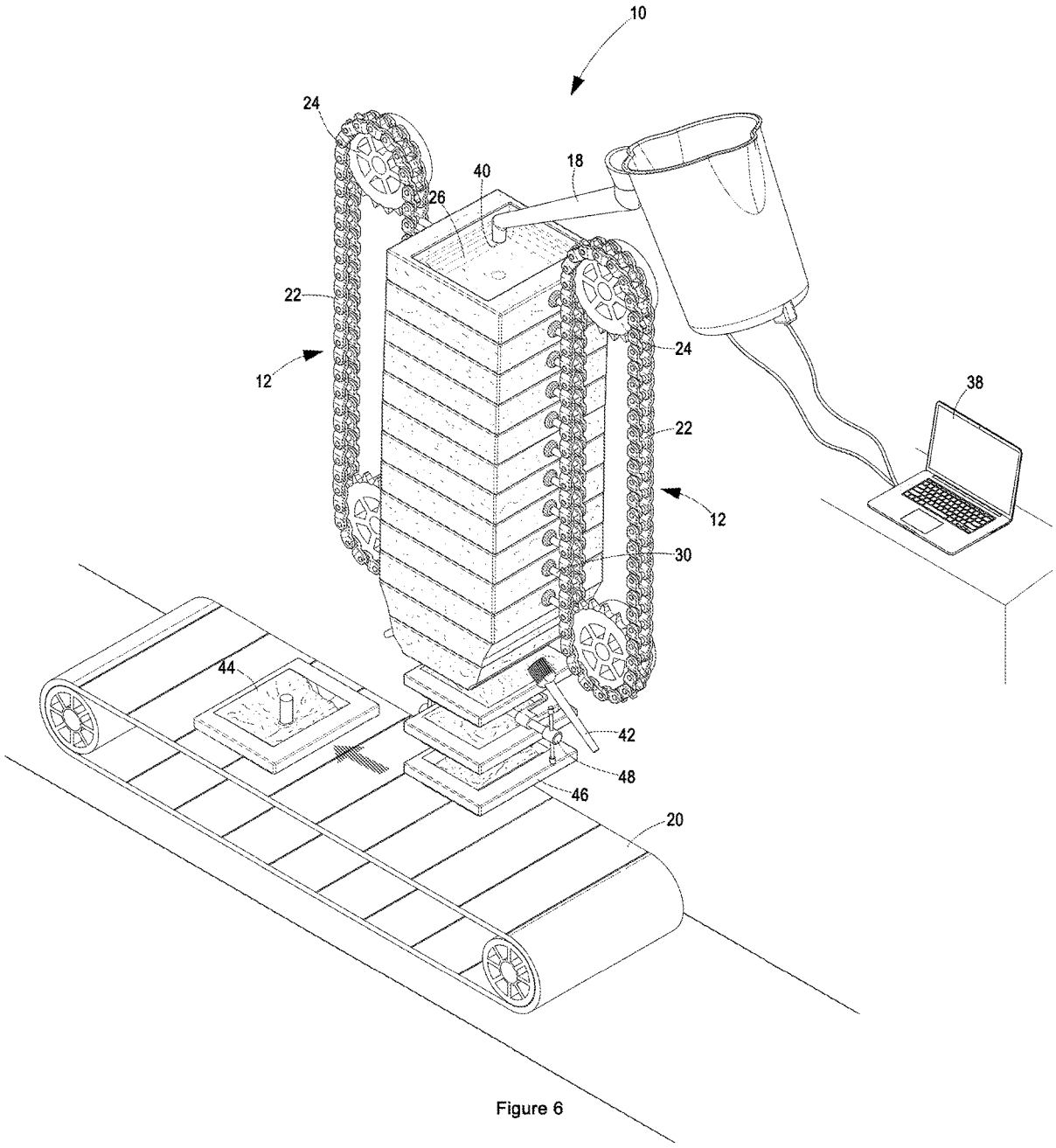
FIG. 6 is a perspective view of the casting system in FIG. 1 showing the first moulded article being conveyed by a conveyor belt.

Referring to FIG. 6, the separated first moulded article 44 is then deposited on the conveyor 20 and conveyed away from the chain and sprocket tower 12.

Although the casting system 10 has been described as having separate sand moulds 14 and 16, the casting system 10 could alternatively include a continuous sand bed (e.g. as described in U.S. Pat. No. 1,049,644) that defines a series of cavities that are in fluid communication with each other. In such an embodiment, a channel could provide fluid communication between adjacent mould cavities.

Furthermore, it will be appreciated that, instead of disintegrating the sand moulds 14 and 16 about the moulded articles 44 and 46, the moulds could alternatively be removed intact from around the moulded articles 44 and 46. Further alternatively, the moulded articles 44 and 46 could be ejected from their respective moulds.

It will also be appreciated that the moulded articles 44 and 46 need not be removed from their moulds 14 and 16 until after the moulded articles 44 and 46 have been severed from each other. Such a modified system would require the clamps 48 to clamp the first and second moulds 14 and 16 containing the first and second moulded articles 44 and 46.

Figure 7:
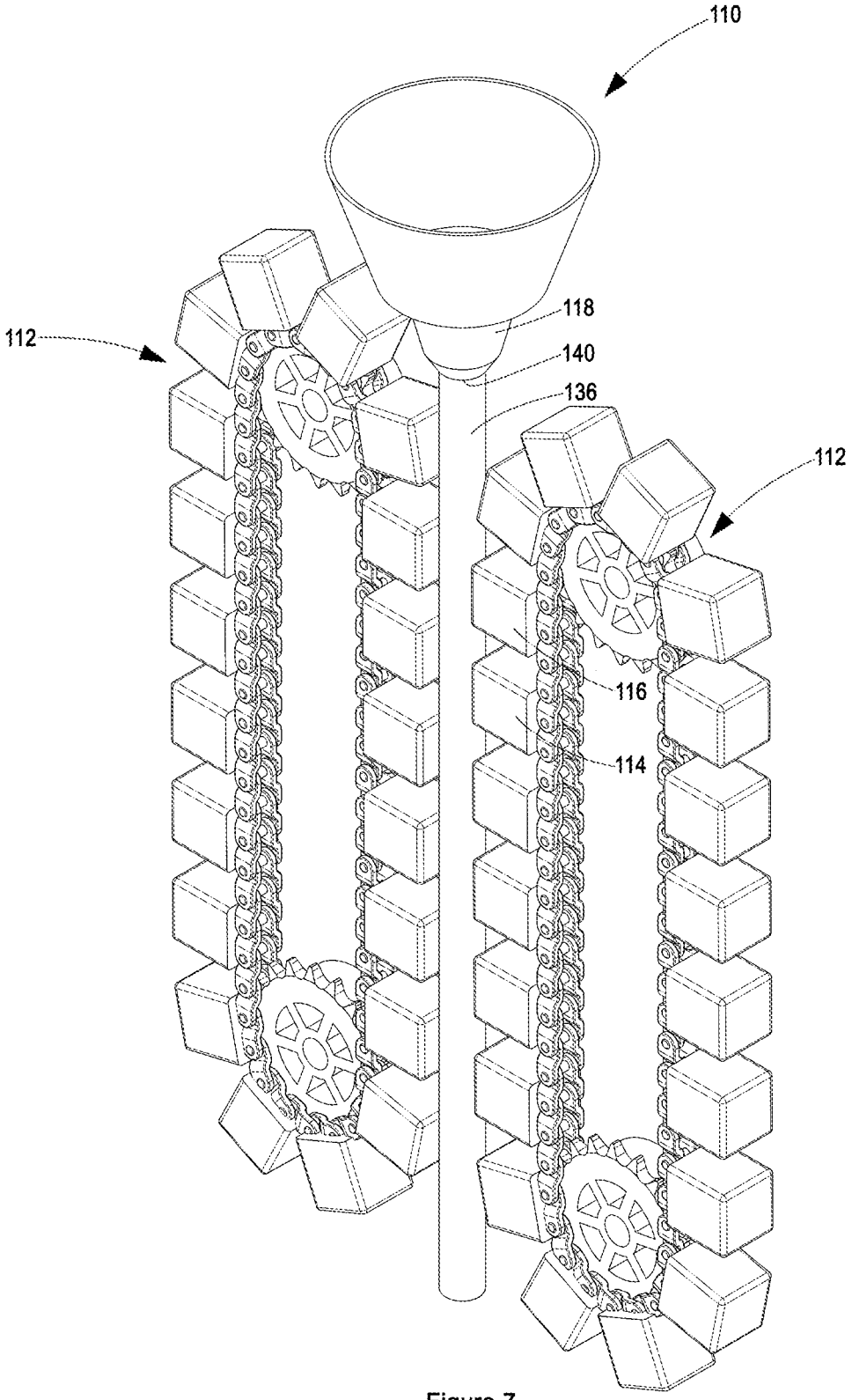
FIG. 7 is a perspective view of a first alternative moulding system that exercises the method according to the invention.

Turning to FIG. 7, a first alternative moulding system 110 includes an extruder 140, a chain and sprocket tower 112, a first mould 114 and a second mould 116.

The extruder extrudes settable material 136 that is contained and moulded radially by the first and second moulds 114 and 116, which moulds 114 and 116 are driven by the chain and sprocket tower 112 in unison with travel of the extruded settable material 136. Since the first and second moulds 114 and 116 are open at their axial ends, shrinkage of settable material 136 within the first mould 114 is at least partially compensated for by the transfer of settable material 136 contained by the second mould 116 to the first mould 114.

It will be appreciated that downward displacement of the moulds 14, 16, 114 and 116 in unison with the settable material 36 and 136 contained therein away from the launder system 18/extruder 118 outlet 40 and 140 coupled with fluid communication between adjacent moulds 14 and 114 on the one hand and 16 and 116 on the other hand facilitates topping up of settable material 36 and 136 in the first mould 14 and 114 in response to shrinkage of settable material 36 and 136 within the first mould 14 and 114 during the casting/moulding process.

Figure 8:
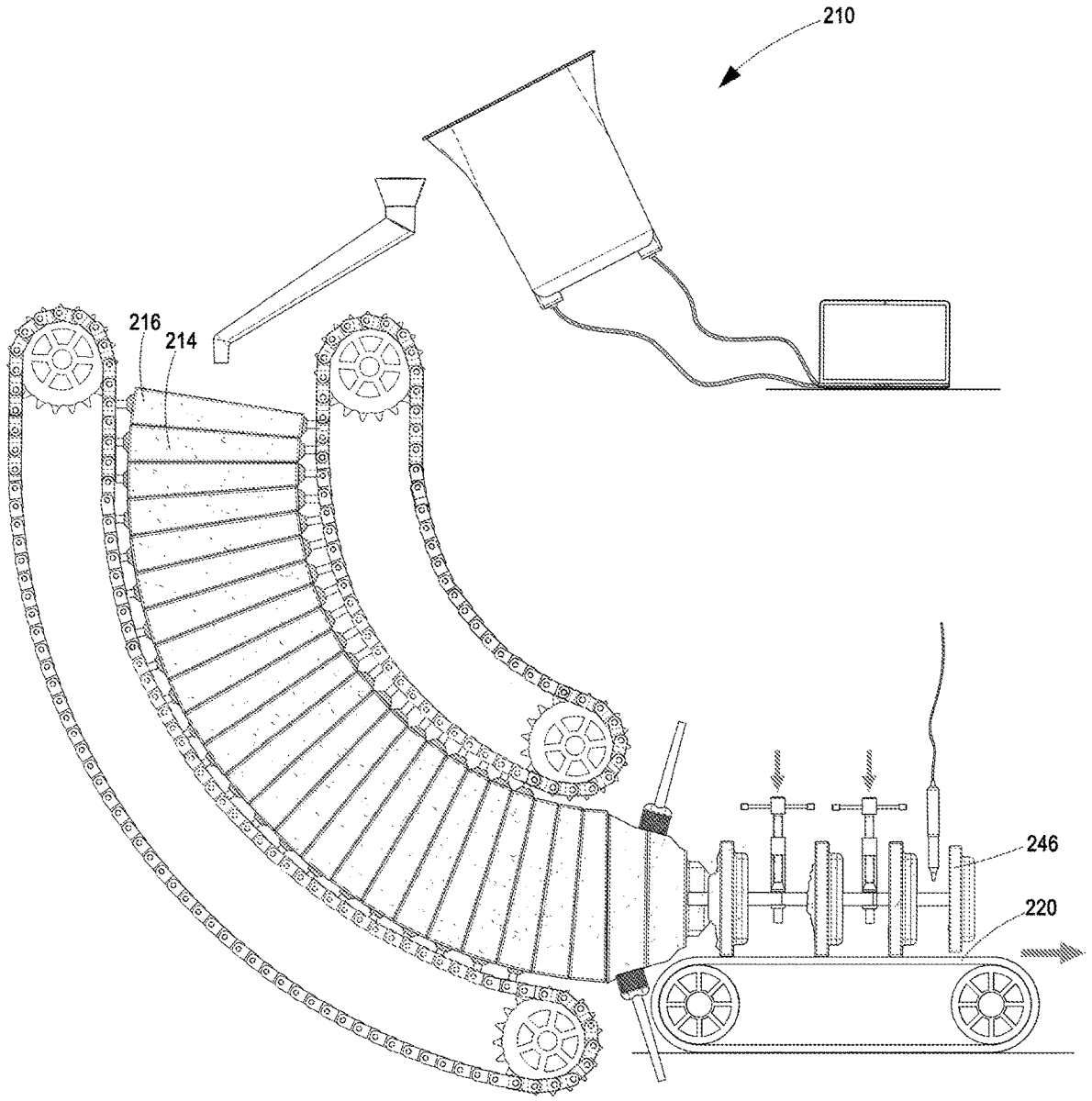
FIG. 8 is a side view of a second alternative moulding system that exercises the method according to the invention.

Optionally, as shown in FIG. 8, the first and second moulds 214 and 216 according to a second alternative moulding system 210 could be wedge-shaped when viewed from a side. By adopting a wedge shape, stacked moulds could form a curved stack (as compared to a vertical linear stack). Further optionally, the stacked moulds could be in a form of an arc with the operatively uppermost mould arranged to travel vertically and the operatively lowermost mould arranged to travel horizontally. This arrangement facilitates support of the lowermost mould/moulded article 246 on a horizontal conveyor 220 prior to severing of the lowermost moulded article from its superjacent moulded article. By providing support to the lowermost moulded article 246 prior to severing, the lowermost moulded article 246 is less prone to damage arising from being dropped.

Further optionally, but not shown, the outlet 40 could comprise a non-linear tube to facilitate insertion of the outlet 40 into a non-linear bore defined by: the first mould 14; the conduit 28; and/or the second mould 16. In such an arrangement, the system 10 could further include means for:

(i) inserting the outlet 40 into the first mould 14 via the second mould 16 and the conduit 28; and (ii) extracting the outlet 40 from the first mould 14 via the conduit 28 and the second mould 16, by moving the outlet 40 along a non-linear path and/or by rotating the outlet 40 during such non-linear movement.

The invention claimed is:

1. A method of moulding a settable material including the steps of:

providing a first mould or mould cavity;

providing an outlet from which a settable material is discharged;

aligning the first mould or mould cavity with the outlet;

discharging settable material from the outlet into the first mould or mould cavity;

providing a second mould or mould cavity;

displacing the first mould or mould cavity away from the outlet;

aligning the second mould or mould cavity with: (i) the outlet; and (ii) the first mould or mould cavity such that the second mould or mould cavity is in fluid communication with the first mould or mould cavity;

discharging settable material from the outlet into the second mould or mould cavity;

permitting a portion of the settable material discharged into the second mould or mould cavity to flow from within the second mould or mould cavity to within the first mould or mould cavity;

further displacing the first mould or mould cavity and the second mould or mould cavity away from the outlet;

permitting: (i) the settable material in the first mould or mould cavity to set into a first moulded article; and (ii) the settable material in the second mould or mould cavity to set into a second moulded article; and severing the first moulded article from the second moulded article.

2. A method of moulding a settable material according to claim 1, further including the step of clamping: (i) the first moulded article or the first mould or mould cavity; and (ii) the second moulded article or the second mould or mould cavity prior to severing the first moulded article from the second moulded article.

3. A method of moulding a settable material according to claim 2, further including the step of: (i) ejecting the first moulded article from the first mould or mould cavity and ejecting the second moulded article from the second mould or mould cavity; or (ii) removing the first mould or mould cavity from around the first moulded article and removing the second mould or mould cavity from around the second moulded article, which step may occur either before or after the first moulded article is severed from the second moulded article.

4. A method of moulding a settable material according to claim 3, wherein the step of severing the first moulded article from the second moulded article is performed by plasma arc cutting, flame cutting or melting using electricity.

5. A method of moulding a settable material according to claim 4, wherein the second mould or mould cavity is in fluid communication with the first mould or mould cavity via a conduit.

6. A method of moulding a settable material according to claim 5, wherein settable material discharged into the second mould or mould cavity flows from within the second mould or mould cavity to within the first mould or mould cavity via the conduit.

7. A method of moulding a settable material according to claim 6, wherein the first moulded article is severed from the second moulded article along the conduit.

8. A method of moulding a settable material according to claim 7, wherein the conduit extends from near the operative bottom of the second mould or mould cavity to near the operative top of the first mould or mould cavity.

9. A method of moulding a settable material according to claim 7, wherein both the first mould or mould cavity and the second mould or mould cavity are sand moulds.

10. A method of moulding a settable material according to claim 9, wherein the first mould or mould cavity and the second mould or mould cavity are connected to a belt or chain loop.

11. A method of moulding a settable material according to claim 10, wherein the belt or chain loop causes and controls movement of the first mould or mould cavity and the second mould or mould cavity.

12. A method of moulding a settable material according to claim 11, wherein the belt or chain loop comprises a chain and sprocket tower.

13. A method of moulding a settable material according to claim 12, wherein bars extending from the first mould or mould cavity and bars extending from the second mould or mould cavity extend to and are connected to the belt or chain loop.

14. A method of moulding a settable material according to claim 12, further including the step of conveying the first moulded article along a conveyor belt after the first moulded article has been severed from the second moulded article.

15. A method of moulding a settable material according to claim 14, further including the step of securing the first mould or mould cavity to the second mould or mould cavity via a clipping arrangement before discharging settable material from the outlet into the second mould or mould cavity.

16. A method of moulding a settable material according to claim 15, wherein: displacement of the first mould or mould cavity; further displacement of the first mould or mould cavity; and further displacement of the second mould or mould cavity, is in an operatively downwards direction.

17. A method of moulding a settable material according to claim 16, wherein the steps of:

displacing the first mould or mould cavity away from the outlet; and aligning the second mould or mould cavity with: (i) the outlet; and (ii) the first mould or mould cavity such that the second mould or mould cavity is in fluid communication with the first mould or mould cavity, are performed simultaneously.

18. A method of moulding settable material according to claim 17, wherein the outlet extends:

through the mould cavity defined by the second mould;

through the conduit; and into the mould cavity defined by the first mould, prior to discharging settable material via the first mould and via the conduit into the mould cavity defined by the second mould.

19. A method of moulding a settable material according to claim 18, wherein the first and second moulds are wedge-shaped to form an arc when stacked.

* * * * *